US006041654A

United States Patent [19]

Stake

[11] Patent Number: 6,041,654

[45] Date of Patent: Mar. 28, 2000

[54] METHOD AND DEVICE IN AN AERIAL TOWED HIT DETECTOR

[75] Inventor: Robert Stake, Jarfalla, Sweden

[73] Assignee: Air Target Sweden AB, Solna, Sweden

[21] Appl. No.: 08/860,509

[22] PCT Filed: Dec. 29, 1995

[86] PCT No.: PCT/SE95/01601

§ 371 Date: Jun. 27, 1997

§ 102(e) Date: Jun. 27, 1997

[87] PCT Pub. No.: WO96/21134

PCT Pub. Date: Jul. 11, 1996

[30] Foreign Application Priority Data

Dec. 29, 1994 [SE] Sweden ..... 9404562

[51] Int. Cl.[7] ..... G01S 3/00; G01S 11/00; F41G 7/00

[52] U.S. Cl. ..... 73/514.35; 244/3.21; 367/124; 367/906

[58] Field of Search ..... 367/906, 127; 273/372; 364/565; 244/3.21; 73/514.35, 649, 652; 702/144, 151

[56] References Cited

U.S. PATENT DOCUMENTS 4,899,956 2/1990 King et al. ..... 244/3.21
5,247,488 9/1993 Borberg et al. ..... 367/124

*Primary Examiner*—Hezron Williams
*Assistant Examiner*—Helen C. Kwok
*Attorney, Agent, or Firm*—Young & Thompson

[57] ABSTRACT

An aerial towed hit detector used together with a sleeve target can obtain an oscillatory movement in the roll angular direction because of the small aerodynamic stability of the target. For determining the path or the miss distance of a projectile passing by the target and the hit detector, the position of the hit detector in the air is measured for allowing a compensation to be made in the determination of hit parameters of the projectile. In the determination of the position of the hit indicator tow accelerometers are used measuring the acceleration laterally or in a tangential direction. One accelerometer is attached to the hit detector and one to the tow rod. By forming the difference of the signals from the accelerometers and integrating the difference signal in two steps information of the angular position of the hit indicator is obtained. This calculation is made in a microprocessor for those times when pressure waves from projectiles hit the hit detector.

6 Claims, 1 Drawing Sheet

METHOD AND DEVICE IN AN AERIAL TOWED HIT DETECTOR

BACKGROUND OF THE INVENTION

The present invention relates to a method and a device for determining the roll angular position of an aerial towed hit detector, where the determination is in particular to be used when towing targets of type non-rigid targets such as sleeve targets.

DESCRIPTION OF THE RELATED ART

When indicating the positions of hits in test firing at aerial towed targets, for example of type sleeve targets, conventionally a hit detector is used, that can be suspended in principle in a cable between the towing aircraft and the target. However, such a hit detector has a not quite stable position, in particular a not stable angular position, but can obtain an oscillating or swinging movement in the roll angular direction or laterally because of the aerodynamic instability of many targets, for example targets made of loose flexible sheet material such as a sleeve target. When making an indication by means of the hit detector various calculation routines are used, which are performed automatically and in which generally the position of the hit indicator is assumed to be known, so that it in many cases is assumed to have for example the same orientation, that is that some reference line in the indicator is located in a vertical plane. However, because of the oscillatory movement of the hit indicator errors will then be introduced in the calculation. It will become particularly observable in the case where hit indicators are made with a high accuracy such as is commonly used nowadays, for example for hit detectors providing an indication within one of twelve possible angular sectors.

In U.S. Pat. No. 5,247,488 a sensor ring 1 is disclosed comprising at least three acoustical detectors 2.1–2.8. The ring is assumed to be attached to the body of a towed target, for the case of "tow-target bags the sensor ring may be part of the wall of the front side electronic cylinder" (col. 3, lines 25–28). Such a ring has no preferred angular position or orientation since the tow target can rotate about a longitudinal axis. For ascertaining the rotational position of the sensor ring with respect to the vertical line a vertical sensor 8 is arranged in a fixed connection to the sensor ring 1 (claim 6). The vertical sensor 8 consists of a mass pendulum 9 and an absolute-angle sensor 10 on a mounting rod 11 extending along a diameter of the sensor ring 1 (col. 2, lines 29–31 and FIG. 1). The signal provided by the absolute-angle sensor 10 is used in calculations of the shot angle.

In the International patent applications having publ. Nos. WO-A1 79/00452 and WO-A1 91/10876 methods and devices are disclosed having arrays of acoustical sensors which would greatly benefit from information on the angular position of the sensor arrays. However, no such orientation sensor means are described in these applications and no hint is given that the provision of such a sensor would favour the calculations that are performed for indicating various hit parameters.

SUMMARY OF THE INVENTION

It is an object of the invention to provide a method and a device for improving the accuracy when indicating various hit parameters, such as miss distance, by means of hit detectors.

It is another object of the invention to provide a method and a device for determining the position of a hit detector that is towed by an aircraft, whereby an increased accuracy can be obtained when indicating hit parameters in relation to an aerial towed target.

Thus generally, one or more hit parameters are determined for a projectile passing in the vicinity of a target. The hit parameters can be miss distance, path or direction of the projectile, etc. The target is provided with some type of hit indicator or hit detector and this senses in the conventional way shock waves generated by the projectile passing through the air. Based on the detected shock waves, calculations are performed for determining the hit parameters. The position of the hit indicator is determined by position determining means all the time or at least at those instances when the shock waves are detected. This determined position is then considered in compensation means in the calculations of the hit parameters of the projectile. The compensation means are preferably incorporated in the means which make the calculation of the hit parameters. In particular, the angular position of the hit indicator can be determined in relation to some reference system that is geometrically related to the earth, such as in relation to a vertical plane passing in the longitudinal direction of the hit indicator or through the connection between the target and a towing airplane.

In the determination of the position of the angular position of the hit indicator the acceleration of the hit indicator can be measured, for example in a tangential direction or in a lateral direction thereof, in the case where it is suspended in the connection between the target and the towing aircraft, such as that the hit indicator comprises a rather heavy body, that is is rigidly joined to a tow rod forming a part of the tow connection.

The position determination means can then include one or more accelerometers located at suitable places at the hit indicator depending on the configuration thereof. The hit indicator can as above in the conventional way comprise a rather heavy indicator body that is suspended in a tow connection, by means of which the target is intended to be towed. The tow connection can comprise a rigid tow rod, which is attached between a tow cable and the target and to which the indicator is attached. The indicator body will, for such a suspension, perform oscillatory movements and an accelerometer can be attached to the body of the hit indicator for sensing the acceleration thereof in directions perpendicular to a plane passing centrally through the hit indicator and through the place connecting the indicator body and the tow connection and in particular through the tow rod. At the place connecting the indicator body and the tow connection then advantageously another accelerometer is attached. It senses the acceleration in the same directions as the accelerometer attached to the indicator body and provides information on the acceleration and position of the connection place.

Also an indicator body, that is located aligned with the connection between a towing aircraft and the target, for example forms a part of the connection of the aircraft and the target, can make oscillatory movements resulting from the movements of the very target. The angular position of an indicator body attached in that way can also be measured by means of suitably located accelerometers.

An alternative method is locating the accelerometers for measuring instead or in addition centripetal acceleration, that is the acceleration in directions perpendicular to those mentioned above. Such a location can primarily result from expecting a smooth velocity in the tangential direction, that is a smooth rolling movement, and no significant tangential acceleration. A third accelerometer can then be required for allowing determination of the rotation direction of the indicator body.

BRIEF DESCRIPTION OF THE DRAWINGS

The invention will now be described with reference to the accompanying drawings in which.

DETAILED DESCRIPTION

Figure 1:
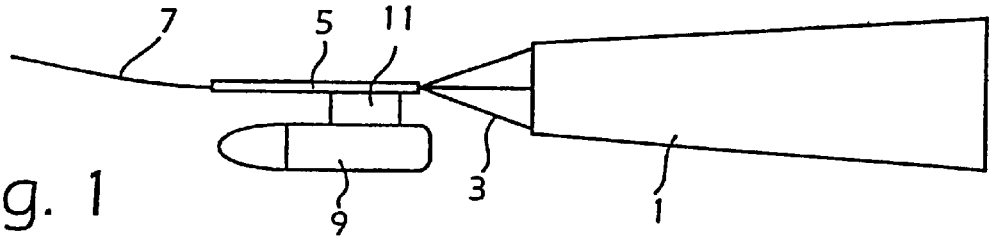
FIG. 1 is a schematic view from the side of a sleeve target towed by an aircraft and comprising an hit detector.

In FIG. 1 a sleeve target 1 is shown as seen from the side thereof. It comprises in the conventional way a tubular device of a flexible sheet material. The sleeve target 1 is attached, at its front, more narrow opening, to the rear end of a rigid tow rod 1 by means of several wires 3. The tow rod 1 is at its front end attached to a tow cable or tow wire 7. The tow cable 7 is at its other end is attached to an airplane, not shown, in order to be towed thereby. To the rigid tow rod 1 a hit indicator 9 is attached comprising an elongated, essentially cylindric hit indicator body. The indicator body is attached to the tow rod 1 by means of a flat web plate 11, so that the longitudinal direction of the hit detector 9 is parallel to the longitudinal direction of the tow rod 5. Usually the tow rod 5, the web plate 11 and the indicator body 9 are all rigid parts that are rigidly attached to each other, so that the assembly of these parts moves as one solid body.

Because of the configuration of the sleeve target 1, primarily because it is made of a rather loose material, it will not be aerodynamically stable. Thus the sleeve target 1 can swing for example laterally, that is to the sides or horizontally and upwards and downwards, as seen in relation to the longitudinal direction thereof. It implies that also the tow rod 1 and the tow cable 7 will oscillate laterally. Such an oscillatory movement will in turn result in an oscillatory movement of the hit detector 9. The hit detector 9 is in the conventional manner arranged for indicating in different ways the positions of projectiles, such as the paths or the miss distances thereof, when test firing at the sleeve target 1. Then automatic routines for calculation of the projectile positions are commonly used, that are for example made by electronic circuits inside the detector 9. In these routines it is presupposed or required that the position of the hit detector 9 is known, and particularly that the position thereof in an angular direction is known. Commonly it is here assumed, that an angular or roll movement of the hit indicator 9 does not occur and that a reference in the hit indicator is always located in some vertical plane, more particularly that the indicator body is located exactly underneath the tow rod 1 and the tow cable. Such an assumption is satisfactory in those cases where the calculations in the indicator are made with a not too high accuracy. However, in the circumstance where the requirements on accuracy are elevated, it may be necessary to acquire information on the position of the hit detector 9.

For this purpose the tow device and in particular the hit detector are provided with suitable position determining means, so that in particular the angular position of the hit indicator can be determined. A conventional measurement detector for the angular position in relation to for example the horizontal plane could be used. However, such a measurement detector is generally intended for static or stationary measurements and will give an erroneous output signal in the circumstance that it is subjected to accelerations of the type experienced by a hit detector. It can be difficult to compensate for these errors.

Figure 2:
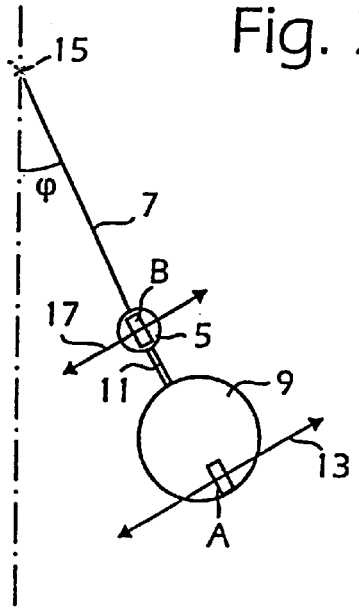
FIG. 2 is a view from the rear, that is in the flight direction, of a towed sleeve target and a hit indicator comprising measurement devices for the angular position.

Therefore a measurement arrangement is proposed that is shown schematically in FIG. 2. Here an accelerometer A is attached to the lower part of the hit detector 9, at the largest possible distance from the tow rod 5. This accelerometer A is arranged to sense movements in lateral directions or in the tangential direction, that is in directions perpendicular to a plane passing through the centers of the hit indicator 9 and the tow rod 5, that is in directions which are principally perpendicular to the large surfaces of the web device 11. These directions are illustrated by the arrows 13 in FIG. 2. By means of the accelerometer A the angular position of the hit indicator 9 can be determined if it is presupposed that the oscillatory movement occurs about an attachment point indicated at 15 at the airplane and if the vertical distance to this point is known.

However, the distance to the upper attachment point, about which the oscillation occurs is not known. Also, the oscillatory movement is most often composite, so that a plane through the tow cable 7 and the plane centrally through the web device 11 can form an angle that generally is small. In order to make the measurements independent of the distance to the upper attachment point another accelerometer B is arranged at the tow rod 1 sensing the acceleration in the same directions as the other accelerometer A. These directions are illustrated by the arrows 17 in FIG. 2, the arrows 13 and 17 thus indicating parallel directions.

If it is assumed that the upper attachment point 15 is fixed, the acceleration of the point, where the upper accelerometer B is attached, has the direction as indicated by the arrows 17, that is in a tangential direction. The value of the acceleration is thus measured by the accelerometer B. This acceleration can be written as $$r_B \frac{d^2\varphi}{dt^2}$$

where $\phi$ is the angle between a vertical plane passing through the point 15 and a plane passing through the tow cable 5 and in the forward flight direction and $r_B$ is the distance from the upper attachment point 15 to the upper accelerometer B, as seen in a horizontal direction. Further, if it is assumed that also the lower accelerometer A is located in said plane extending through the tow cable 5 and in the forward flight direction, that is that there is no composite movement, the acceleration of the point where the lower accelerometer A is attached also has a direction as indicated by the arrows 13 (or 17) and the acceleration of this point is thus measured by the accelerometer A. The value of the acceleration of the point where the lower accelerometer A is attached can then be written $$r_A \frac{d^2\varphi}{dt^2}$$

where $r_A$ is the distance, as seen in a horizontal direction in said plane, from the upper attachment point 15 to the lower accelerometer A. Then the difference of the accelerations of the points of the lower and upper accelerometer A, B is $$r_A \frac{d^2\varphi}{dt^2} - r_B \frac{d^2\varphi}{dt^2} = r \frac{d^2\varphi}{dt^2}$$

where r is the distance in said plane, as seen in a horizontal direction, between the points where the accelerometers A, B are attached, that is generally the depth or width of the web plate 11, and is thus known and constant. Thus the measured accelerations can be subtracted and then divided by this depth or width r to form a value of the second derivative of the angle $\phi$ in regard of time. This value can then be integrated twice for forming a value of the angular position $\phi$.

In the case where the upper attachment point 15 moves in various directions and thus has an acceleration, this movement will be superposed on the case discussed above. However, an equal amount will then be added to the accelerations of the points where the accelerometers A, B are attached. By making the subtraction as described above, this equal added amount will not influence the result of the subtraction.

Figure 3:
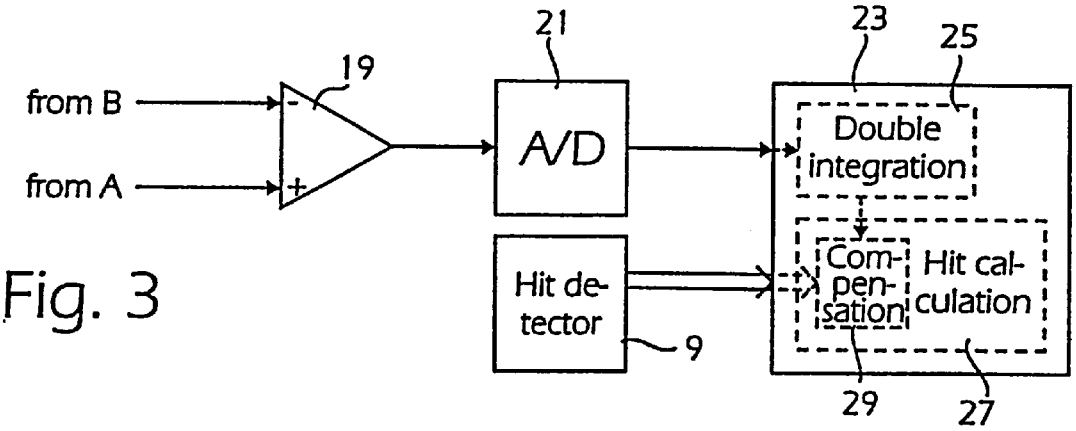
FIG. 3 is a schematic block diagram of a circuit including a calculation routine that is required for improving accuracy when indicating hit parameters.

Thus, for determining the angular position the signals from the two accelerometers A and B can be provided to a subtraction circuit 19, see the block diagram of FIG. 3. By means of the subtraction components in the signals from the accelerometers can be compensated, for example as discussed above but also possibly some noise signals, etc. The difference signal formed by the subtraction circuit 19 is provided to an analog to digital converter 21 where the difference signal is converted to a digital shape and is provided to a microprocessor 23. In the microprocessor 23, in integration routines 25 therein, the difference signal is integrated twice for determining the angular position of the hit detector or hit indicator 9, that is for determining the angle, that a plane passing centrally through the hit indicator 9 and the tow rod 5 forms to the vertical plane.

In the microprocessor 23 also calculations are made, based on signals from the hit indicator 9, for determining intended hit parameters in a calculation block 27 comprising routines 29 for compensation or consideration of the position of the hit indicator 9.

I claim:

1. A method of determining hit parameters of a projectile passing in the vicinity of a target provided with a hit indicator comprising an indicator body suspended in a tow connection, by means of which the target is intended to be towed, the method comprising the steps of:

detecting, at the hit indicator, shock waves generated by the projectile, determining a value of an angular position of the hit indicator body at instances when the shock waves are detected, making, based on results obtained in the step of detecting and on the value of the angular position, calculations for determining the hit parameters, wherein, in the step of determining a value of the angular position, the value of the angular position of the hit indicator body is determined by first measuring a body acceleration of the hit indicator body in a body measuring direction perpendicular to a plane through the indicator body and the tow connection and thereupon integrating the measured acceleration for finding a value of the angular position.

2. The method of claim 1, wherein, in the step of determining a value of the angular position of the hit indicator body, a connection acceleration at a connection place located between the indicator body and the tow connection is measured in the body measuring direction, and thereupon a difference of the measured body acceleration and the connection acceleration is integrated.

3. The method of claim 1, wherein, in the step of determining a value of the angular position of the hit indicator body, the angular position is determined in relation to a reference that is fixed to the earth.

4. A device for determining hit parameters of a projectile passing in the vicinity of a target, the device comprising:

a hit indicator connected to the target for detecting shock waves generated by the projectile, the hit indicator comprising an indicator body suspended in a tow connection, by which the target is intended to be towed, an angular position determining means comprising:

a first accelerometer attached to the hit indicator body for providing a first signal representing the acceleration of the hit indicator body in a body measuring direction perpendicular to a plane through the indicator body and the tow connection, an integration means connected to the first accelerometer for receiving the first signal and for deriving from the first signal a value of an angular position of the hit indicator body, and a calculating means connected to the hit indicator and to the angular position determining means for making, based on the detecting of the shock waves and the value of the angular position, calculations to determine the hit parameters.

5. The device of claim 4, wherein the angular position determining means further comprises:

a second accelerometer attached at a connection place between the hit indicator body and the tow connection for providing a second signal representing the acceleration in the body measuring direction at the connection place, and a difference forming means connected to the first and second accelerometers to receive the first and second signals and to form a difference signal representing the difference between the first and second signals, the difference forming means being further connected to the integration means for providing the difference signal to the integration means and the integration means using the difference signal in deriving the value of the angular position.

6. The device of claim 4, wherein the angular position determining means are arranged to determine the angular position of the hit indicator body in relation to a reference fixed to the earth.

* * * * *